US005864883A

United States Patent [19]

Reo

[11] Patent Number: 5,864,883

[45] Date of Patent: Feb. 2, 1999

[54] SELF-SEALING TISSUE MITT WITH SHIELD

[76] Inventor: Patricia M. Reo, 3314 Mystic Port Pl., Toms River, N.J. 08753

[21] Appl. No.: 50,233

[22] Filed: Mar. 30, 1998

[51] Int. Cl.[6] ..... A41D 19/01

[52] U.S. Cl. ..... 2/158; 2/161.6; 206/438

[58] Field of Search ..... 2/158, 159, 160, 2/161.6, 161.7, 167, 168, 16; 294/1.3; 15/227; 206/438, 363, 278; 383/77, 93, 907

[56] References Cited

U.S. PATENT DOCUMENTS

| | | | |
|---|---|---|---|
| 2,782,912 | 2/1957 | Humphrey | 2/158 |
| 3,608,708 | 9/1971 | Storandt | 2/158 |
| 4,718,125 | 1/1988 | Derda et al. | 2/158 |
| 4,845,780 | 7/1989 | Reimers et al. | 2/160 |
| 4,884,300 | 12/1989 | Vistins | 2/160 |
| 4,937,881 | 7/1990 | Heise | 2/158 |
| 4,959,881 | 10/1990 | Murray | 2/158 |
| 5,020,159 | 6/1991 | Hellickson | 2/158 |
| 5,196,244 | 3/1993 | Beck | 2/158 |
| 5,438,708 | 8/1995 | Jacovitz | 2/161.6 |
| 5,740,554 | 4/1998 | Reed | 2/158 |

*Primary Examiner*—Amy B. Vanatta
*Attorney, Agent, or Firm*—Charles I. Brodsky

[57] ABSTRACT

A self-sealing mitt of the hand-insert pouch type including a plastic bag, a layer of absorbent material attached to a first surface thereof, and one or more tabs secured at lower locations on the bag for grasping and pulling of the bag onto itself about the tissue, with adhesive couplings with the tabs to seal the absorbent material within when removing and disposing of the bag to provide a shield against virus, bacteria and other infecting germs in connection with which the tissue is employed.

14 Claims, 2 Drawing Sheets

SELF-SEALING TISSUE MITT WITH SHIELD

FIELD OF THE INVENTION

This invention relates to a wiping mitt of the hand-insert pouch type and, more particularly, to a mitt which is especially effective as a barrier affording protection against infection through colds, flu, bronchitis, pneumonia, AIDS, TB germs and most any other type of upper respiratory ailment where mucous is involved.

BACKGROUND OF THE INVENTION

Wiping mitts, of hand-insert pouch type have been described in the prior art. Typical are those described in U.S. Pat. Nos. 4,645,251; 4,788,733; 4,902,283; and 4,959,881. The first of these prior art references discloses a glove for dealing with animal wastes, and other waste products, and employs an inner glove and an outer glove, with the outer glove being stripped off of the inner glove into an inside-out pouch to contain the picked-up waste material in the pouch so formed. The second of these prior art patents similarly describes a glove of thin plastic material, covered over with a towel layer impregnated with a cleaning solution—with the towel area being used in cleaning the crotch of a baby, and when completed, the glove is turned inside-out to enclose the soiled articles with a tie to close-off the opening of the bag. The third of these typical descriptions also is concerned with a baby-wipe including a pair of water-repellant layers to receive a hand—in which a cotton outer layer to wipe a baby clean is shown with an inner layer being water repellant. (As with the two prior references, after use, the mitt is everted so that the inner layers become the outer layers to form a waste bag in which the wearer need never touch the soiled material.) The fourth of these references shows a particular construction of a cleaning mitt for cleaning various surfaces—and includes the cleaning solution as part of its construction, arranged so as to protect the hand against this cleanser or disinfectant, with the mitt being thrown away after use, although without any rolling-over of it into itself.

Other prior art references in this general field include U.S. Pat. Nos. 4,964,188; 5,178,426; and 5,301,806. The first one here describes a fabrication of a bag in the form of a glove for scooping up dog droppings, in which a padding material on the outside of the bag enables absorption of any moisture present, while allowing the user to pick up excrement. (Additionally, the arrangement permits a user to turn the bag inside-out so that the specimen is contained inside the bag, which is then tied off and thrown away.) The second patent in this grouping similarly is concerned with picking up after a dog, and shows a somewhat complicated arrangement of a combined pad and bag to pick up after the animal and for carrying away the droppings after use—in which the pad and bag is foldable so that it can be stored and carried in a pocket, purse or hand. The third reference, here, like the one before it, also combines a plastic bag in a glove with padded material to absorb moisture contained in excrement, which is intended to be used in picking up after the animal—in this construction, however, the pad is impregnated with a disinfectant, or a solvent to clean up waste, and after which a user turns the bag inside-out so that the waste is contained inside, by pulling tightly on included drawstrings.

Japanese Patent No. 22,701, on the other hand, shows a bag to be used in a hospital environment, incorporating a cloth adhesion to the outside of a water impermeable bag, to be turned inside-out and discarded after use.

While these mitts of the hand-insert pouch type may work adequately well for cleaning and wiping purposes, their constructions are not readily adaptable to effective use in virus/bacteria protection, nor in instances where manufacturing costs are required to be kept minimally low. While the concept of having a glove which can be essentially transformed into a bag to facilitate disposal of a soiled article is quite desirable, many times the article to be disposed of is in the nature of mucous produced through a sneeze, a cough, a spit, or a nose blow. The constructions set forth in these, and similar such, prior references are all too complex, too cumbersome, and too expensive, where all that is simply needed is an inexpensive tissue for use. To then protect against infection which could thus arise in this manner from colds, flu, bronchitis, pneumonia, AIDS, TB germs, and other upper respiratory problems where mucous is involved, a sealing mechanism should be had—somewhat along the lines of those obtainable with the prior art, but one which is much less expensive to produce, while being exceedingly easy to operate, without requiring further contact between the virus/bacteria and a user's hand.

OBJECTS OF THE INVENTION

It is a object of the present invention, therefore, to provide a hand-insert pouch type mitt which is particularly effective as a virus/bacteria, mucous barrier.

It is an object of the present invention, also, to provide such a mitt which can be self-sealed without the necessity for a user coming into contact with the infected area sneezed, spit, coughed or nose-blown into.

It is another object of the invention to provide a self-sealing mitt of this type which can be inexpensively manufactured in order that the resulting product can be sold through mass-market means, as in a supermarket.

It is yet a further object of the invention, to provide such a self-sealing mitt which can be packaged in a manner as boxes (or rolls) of tissues are presently made available for purchase, and which can be sold at prices competitive therewith.

SUMMARY OF THE INVENTION

As will become clear from the following description of a preferred embodiment of the invention, the self-sealing mitt of the invention essentially comprises four component parts: a) a tissue; b) a thin plastic bag; c) adhesive(s); and d) one or two tabs. As will be seen, in its manufacture, the mitt has the tissue fused to the outside of the thin plastic bag, with an opening for the hand. The one or two tabs, with the adhesive coupling, may be on the front or back surfaces of the plastic bag, or on both, for convenience in removing the plastic bag from the hand on which it rests, and in disposing of the plastic bag after use.

As will become clear from the description that follows, after the tissue is used for sneezing, spitting, coughing or nose blowing into, either or both tabs can be pulled and folded so as to flip the offending tissue inside the plastic bag, while holding the bag in place with the fingers of the inserted hand. The thin plastic bag so pulled and folded over is then completely rolled over the hand, in a manner to expose the adhesive to then stick onto the plastic bag for completely enclosing the tissue within. The then everted bag can then be disposed of simply, without any further contact with the hand, permitting the hand to continue germ free. As will be described below, the tab(s) can be fabricated so as to have the self-sealing adhesive as part of its construction—while in an alternative embodiment of the invention, the tab(s) can temporarily overly an adhesive patch on the thin plastic bag, which then establishes the sealing join when the bag is folded over into itself, with the tab(s) being then discardable.

BRIEF DESCRIPTION OF THE DRAWINGS

These and other features of the present invention will be more clearly understood from a consideration of the following description, taken in connection with the accompanying drawing in which.

DETAILED DESCRIPTION OF THE DRAWINGS

Figure 1:
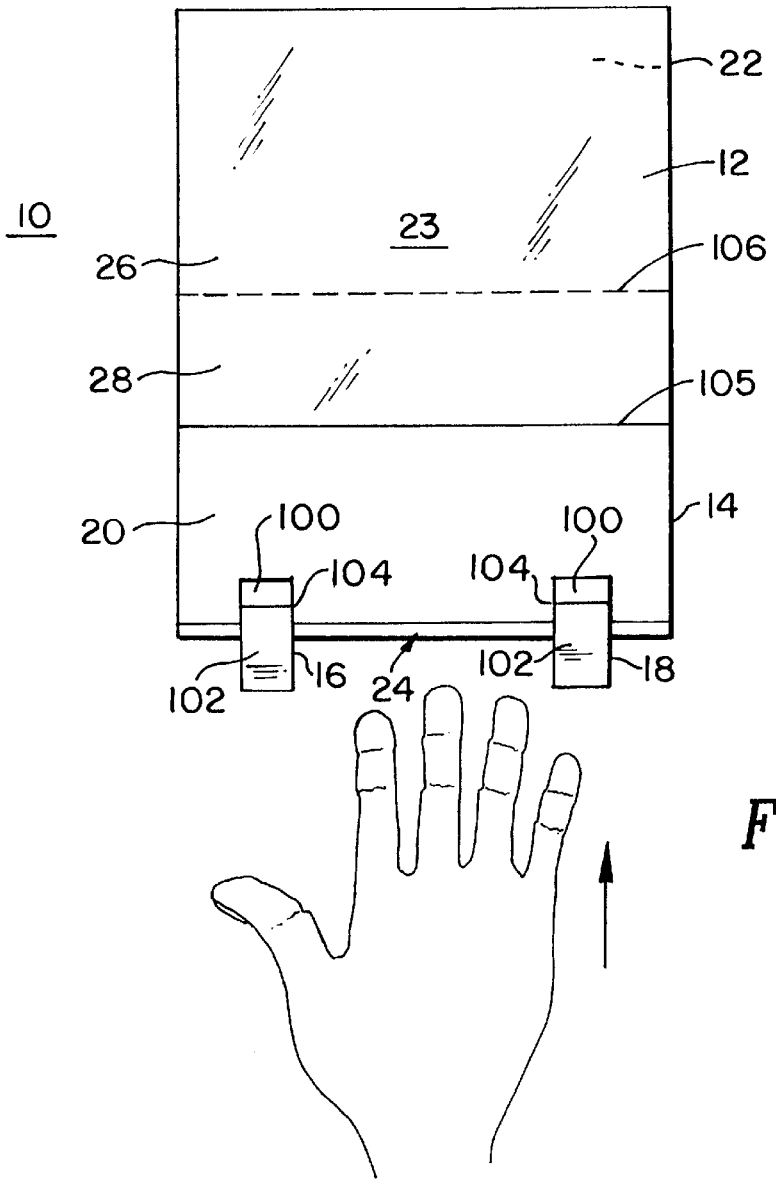
FIG. 1 illustrates a preferred embodiment of a self-sealing mitt according to the invention, for shielding a user's hand in a virus/bacteria mucous barrier.
Figure 2:
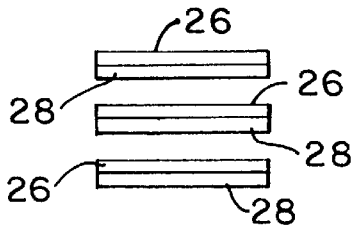
FIG. 2 illustrates a manner of how the self-sealing mitt of FIG. 1 may be arranged for packaging for supermarket sale.

In FIGS. 1 and 2, the self-sealing mitt 10 essentially comprises four component parts: a) a tissue 12; b) a thin plastic bag 14; c) a pair of tabs 16, 18; and d) an adhesive. In the embodiment of FIGS. 1 and 2, the adhesive will be appreciated as being below the tabs 16, 18, i.e., on the surface of the plastic bag 14, beneath section 100 of the tabs 16, 18, the section 102 of the tabs 16, 18 being the portion of the tab that is grasped and pulled upon in folding over the plastic bag 14 in flipping an offending tissue 12 inside the bag 14, as in the illustrations of FIGS. 3 and 4.

As will be appreciated, the plastic bag 14, for all intents and purposes, forms a glove to be located about a hand of a user—with a front surface 20 at the palm area of the hand, with a rear surface 22 positioned at the back area of the hand, and with an access opening 24 for inserting the hand in putting on the glove. As shown, the tissue 12, in this arrangement, typically is a layer of absorbent material attached to the front surface 20 of the glove so formed, at an upper location 23 thereon extending from the line 105. The first tab 16 is then shown at a lower location on one of the front and rear surfaces, and with the second tab 18 at a lower location on the other of the front and rear surfaces 20, 22.

In a preferred manufacture of the self-sealing mitt 10, the tissue 12 is fused to the outside of the plastic bag 14 along the front surface 20. Although only one tab is required for convenience in removing and disposing of the plastic bag after use, a pair of such tabs are preferably employed. In selecting the composition for the plastic bag, its construction is intended to be of a material to permit adherence to the adhesives in sealing the back when the glove so formed is turned to its inside-out position, by grasping and pulling on either or both of the tabs 16, 18.

In the preferred embodiment of FIGS. 1–4, an absorbent tissue material 12 is fused to the front surface 20 of the bag 14 forming the glove. In selecting the material for the plastic bag 14, a preferable material is one of square-shape configuration, of thin-sheet plastic construction. In a more elaborate use, where the mitt 10 is intended for washing, sterilization and reuse, the glove may be constructed of a fabric material instead of a thin-sheet plastic, though of a pore size impervious to the passage of bacteria and virus. As will be appreciated, the tabs 16, 18 are folded along the separation line 104, between the sections 100, 102—with the section 100 overlying the adhesive coupling for the self-sealing of the mitt 10.

FIG. 2, moreover, illustrates a manner by which the self-sealing tissue mitt with the virus/bacteria mucous barrier shield may be folded for insertion one-atop-another in a box dispenser in a manner to facilitate easy removal thereof, one-at-a-time, in a way analogous to the removal of individual tissues, one-by-one, from a conventional box dispenser. As indicated, the mitt 10 can be folded over about the line 106, resting a first portion 26 of the tissue 12 atop a second portion 28—preferably for the type of embodiment where the adhesive lies under the tab section 100, so as to be protected thereby, unexposed, until the mitt 10 is removed from the dispenser, ready for insertion of the hand into the access opening 24. In this manner, any sticking of one such mitt 10 to another above it, or to one below it, is prevented.

Alternatively, and as will be understood, the self-sealing tissue mitt of the invention can be packaged as on a large roll, with perforations between adjacent mitts similarly rounded, for separation one-from-the-next, by a tearing along the perforation in any well known manner.

In use of the invention, the hand is placed through the opening 24 into the plastic bag glove, with the tissue 12 on the outside of the bag above the palm. The tissue can then be used to sneeze, spit, cough or have a nose blown into—either by the user himself or herself, or upon another, such as a child, an ailing person, or one confined to bed. The tissue 12, or other layer of absorbent material so employed, can then be used in any manner where mucous is involved, with the bag thereafter being self-sealed for discarding.

Figure 3:
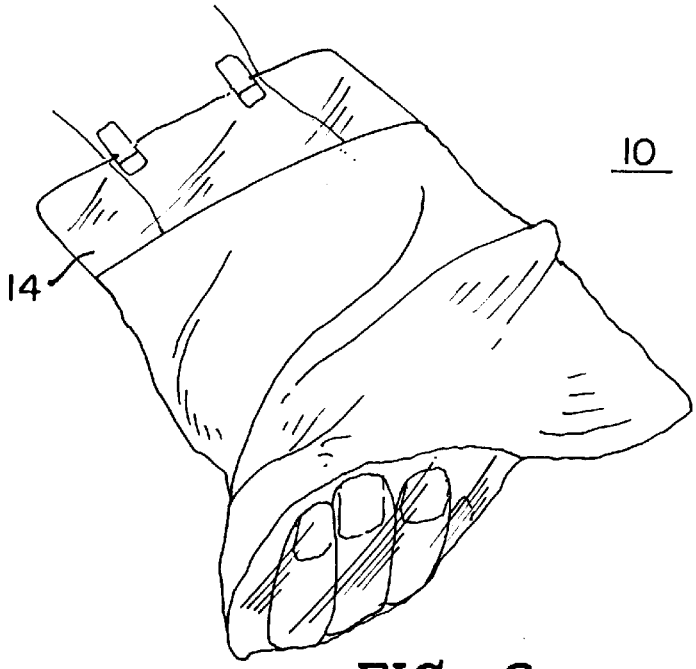
FIGS. 3 and 4 are illustrations of the rolling-over of the mitt with respect to the hand, with the adhesive of the invention completely enclosing the tissue within the folded-over bag, thereby illustrating a manner of carrying out the teachings of the invention.
Figure 4:
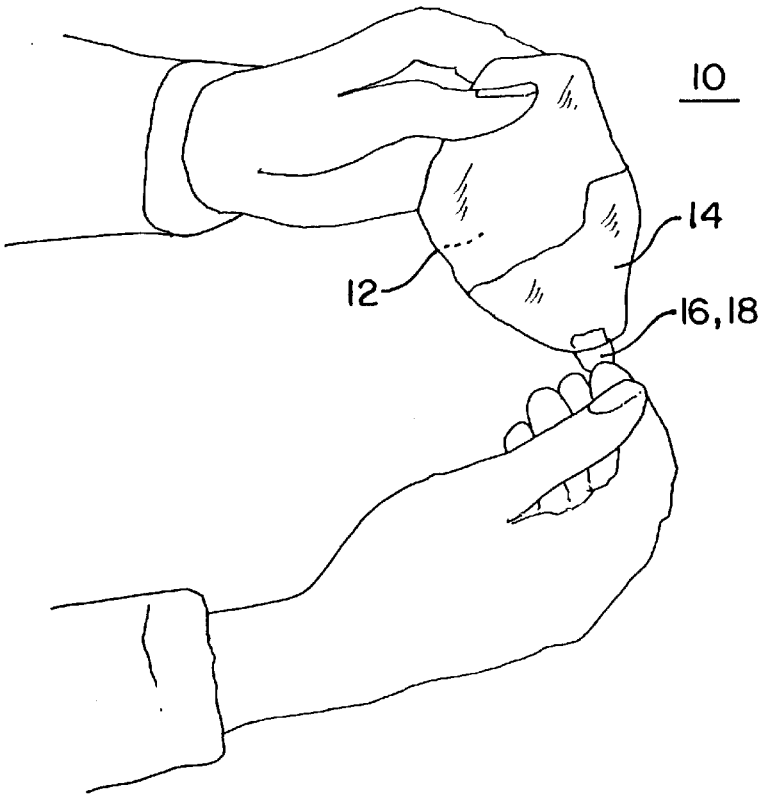

Thus, as in FIGS. 3 and 4, the tabs 16, 18—or either one of them—could be grasped, pulled and folded over so as to flip the offending tissue inside the plastic bag, facilitated in doing so by exerting a nominal grasping pressure on the inside of the bag to which the absorbent layer is fused, and with the fingers of the hand inside the bag. After the bag is thus everted with the tissue then fitting inside, the bag 14 is continued to be rolled over the hand, with the adhesive coupling either on the tab section 100, or exposed by pulling off the tab when on the bag itself, then sticking to the plastic of the other surface in completely enclosing the tissue 12 within the then folded-over bag. As such, the folded over bag, with the tissue sealed inside can be disposed of simply, without any further contact with the hand on which it was placed. With the adhesive coupling either on the section 100 of the tabs 16, 18, or with the adhesive area exposed on the front and rear surfaces 20, 22 exposed through the removal of the tabs when pulling over the bag, a sealing of the offending tissue thus results in preventing any air-borne virus/bacteria. The tab(s), when removed to expose the adhesive on the surfaces 20, 22 in that construction can, of course, simply be discarded along with the then sealed mitt.

Analysis of the invention has shown that by using a typical tissue type absorbent material layer along with a thin-sheet plastic material—preferably of a square-shape configuration—, boxes of these self-sealing tissue mitts can be reasonably sold at prices some 2–4 times that of a conventional box of just plain tissues. Further analysis has indicated such price to have wide consumer acceptance—especially in view of the further advantages of the invention of shielding the infecting virus, bacteria and germs associated with such mucous from infecting the area of use, as well as the person of the user.

While there have been described what are considered to be preferred embodiments of the present invention, it will be readily appreciated by those skilled in the art that modifications can be made without departing from the scope of the teachings herein of employing disposable mitts of a hand-insert pouch type which are turned inside-out for disposal while sealing, at the same time, the bagged offending tissue in limiting air-born virus/bacteria. For at least such reason, resort should be had to the claims appended hereto for a true understanding of the expanse of the invention.

I claim:

1. A self-sealing mitt comprising:

a glove adapted to be located about a hand of a user, having a front surface at the palm area of the hand, a rear surface positioned at the back area of the hand, and an access opening for inserting the hand in putting on said glove;

a layer of absorbent material attached to said front surface of said glove at an upper location thereon;

a first tab at a lower location on one of said front and rear surfaces of said glove coupled with a first adhesive;

a second tab at a lower location on the other of said front and rear surfaces of said glove coupled with a second adhesive; and with said glove being constructed of a material to permit adherence to said first and second adhesives on said front and rear surfaces of said glove in closing and sealing said glove when turning said glove to an inside-out position by grasping and pulling on one of said first and second tabs.

2. The self-sealing mitt of claim 1 wherein said absorbent material is a tissue fabric.

3. The self-sealing mitt of claim 1 wherein said absorbent material is fused to said front surface of said glove.

4. The self-sealing mitt of claim 1 wherein said glove is constructed of a thin-sheet plastic material.

5. The self-sealing mitt of claim 1 wherein said glove is constructed of a plastic material of square-shape configuration.

6. The self-sealing mitt of claim 1 wherein said glove is constructed of a fabric material of a pore size impervious to the passage of bacteria and virus.

7. A self-sealing mitt comprising:

a glove adapted to be located about a hand of a user, having a front surface at the palm area of the hand, a rear surface positioned at the back area of the hand, and an access opening for inserting the hand in putting on said glove;

a layer of absorbent material attached to said front surface of said glove at an upper location thereon;

a first adhesive at a lower location on one of said front and rear surfaces of said glove;

a first tab overlying said first adhesive;

a second adhesive at a lower location on the other of said front and rear surfaces of said glove;

a second tab overlying said second adhesive; and with said glove being constructed of a material to permit adherence to said first and second adhesives on said front and rear surfaces of said glove in closing and sealing said glove when turning said glove to an inside-out position by grasping and pulling on one of said first and second tabs, and to free the tab pulled from the adhesive underneath.

8. The self-sealing mitt of claim 7 wherein said absorbent material is a tissue fabric.

9. The self-sealing mitt of claim 8 wherein said tissue fabric is fused to said front surface of said glove.

10. The self-sealing mitt of claim 8 wherein said glove is constructed of a thin sheet of plastic material.

11. A self-sealing mitt comprising:

a glove adapted to be located about a hand of a user, having a front surface at the palm area of the hand, a rear surface positioned at the back area of the hand, and an access opening for inserting the hand in putting on said glove;

a layer of absorbent material attached to said front surface of said glove at an upper location thereon;

a first tab attached to a bottom end of one of said front and rear surfaces of said glove, and having a first adhesive layer on a downwardly extending length thereof;

a second tab attached to a bottom end of the other of said front and rear surfaces of said glove and having a second adhesive layer on a downwardly extending length thereof;

and with said glove being constructed of a material to permit adherence to said front and rear surfaces of said glove in closing and sealing said glove when turning said glove to an inside-out position by grasping and pulling on one of said first and second tabs.

12. The self-sealing mitt of claim 1 wherein said absorbent material is a tissue fabric.

13. The self-sealing mitt of claim 1 wherein said absorbent material is fused to said first surface of said glove.

14. The self-sealing mitt of claim 11 wherein said glove is constructed of a thin-sheet plastic material.

* * * * *